United States Patent [19]

Sahay

[11] 4,372,675

[45] Feb. 8, 1983

[54] VARIABLE POWER FUSER CONTROL

[75] Inventor: Ravi B. Sahay, Penfield, N.Y.

[73] Assignee: Xerox Corporation, Stamford, Conn.

[21] Appl. No.: 210,903

[22] Filed: Nov. 28, 1980

[51] Int. Cl.[3] ..... G03G 15/00; G03G 15/20

[52] U.S. Cl. ..... 355/14 FU; 219/216; 355/77

[58] Field of Search ..... 355/14 FU, 3 FU, 77; 219/216, 388, 482, 483, 485

[56] References Cited

U.S. PATENT DOCUMENTS

| | | | |
|---|---|---|---|
| 3,532,855 | 10/1970 | Van Cleave | 219/216 |
| 3,735,092 | 5/1973 | Traister | 219/501 |
| 3,881,085 | 4/1975 | Traister | 219/216 |
| 4,318,612 | 3/1982 | Brannan et al. | 355/14 FU |

FOREIGN PATENT DOCUMENTS

| | | | |
|---|---|---|---|
| 2340662 | 2/1977 | France | 219/485 |

*Primary Examiner*—R. L. Moses

*Attorney, Agent, or Firm*—Ronald F. Chapuran

[57] ABSTRACT

The present invention is a machine control having a programmable non-volatile memory and microprocessor to control power to a fuser lamp in a manner to adapt the machine to distinct power outlets. The non-volatile memory is programmed to indicate the availability of a particular power output. The control monitors the memory and in turn gates a triac controlling the fuser lamp to apply the maximum possible power to the fuser. If the machine is operating at a 3.0 of a 2.2 kva outlet, full power could not be delivered to the fuser while the machine is operating. The machine would adapt to operate at reduced power to the fuser until the fuser temperature drops below a minimum temperature level.

11 Claims, 4 Drawing Figures

102
100

3.3 KVA
30 KVA
2.2 KVA
1.5 KVA
CONTROL
104
96
112
P.S.
94
POWER
INPUT

VOLTAGE
TIME
CYCLE STEALING METHOD TO
CONTROL FUSER POWER

STANDBY
T1
TEMP.
To
STANDBY
0
40
80
120
NO. OF COPIES

VARIABLE POWER FUSER CONTROL

This invention relates to reproduction machines and in particular to apparatus and methods for adapting a reproduction machine to different power outlets.

One of the major demands for power in a reproduction machine is from the fuser. For example, a typical machine operating at full power from a 3.3 kva outlet uses 1200 watts to operate the fuser, the remaining power being delivered to the other operating stations. Suppose, however, the machine is plugged into a 3.0 kva outlet or even a 1.5 kva outlet. The available power is substantially diminished.

To accomodate less available power, it is known in the prior art to switch off power to the machine fuser when the other machine components are running and operate the fuser only on stored power in the form of heat. The fuser will operate until falling below a predetermined temperature. At that time, the machine will cease operation and remain in a standby condition. Power will be switched to the fuser until the fuser temperature has been raised to a level suitable to continue operation of the fuser without drawing any more of the input power. At this time, the machine is ready for operation. That is, the machine components other than the fuser will draw all the available power, while the fuser again operates with stored heat power.

A difficulty with this type of operation is that specific hardware must be incorporated into the machine for each different power environment to adapt the machine and the fuser to run on the available power. This solution also may ignore some additional power that may be available for the fuser. For example, in the above typical example, 3.3 kva is available with approximately 2100 watts to the reproduction machine and 1200 watts to the fuser. If the machine, however, is plugged into a 3.0 kva outlet, 2100 watts would still be available for the operating components, and 900 watts would be available to the fuser. Even if the outlet is 2.2 kva, 100 additional watts would still available for the fuser.

It would therefore be desirable, to be able to adapt a machine to various power availability requirements in a simple and economical manner by applying the needed power to the operating components of the machine using the available remaining power for the fuser operation.

It is also known in the prior art to control the power input to a heating lamp irrespective of variations in line voltage. For example, U.S. Pat. No. 3,881,085 teaches the use of a heating lamp connected to a power source through a silicone controlled rectifier (SCR). Line voltages across the heating lamp are constantly monitored by a transformer. The output of a transformer charges a capacitor in order to switch an amplifier to the conductive state. Switching the amplifier to the conductive state, in turn inhibits the SCR for interrupting power to the heating lamp to compensate for variations in line voltage.

It is also taught in copending application U.S. Ser. No. 111,048 by Jerome S. Raskin et al, entitled Fuser Control, filed Jan. 10, 1980, to use a microprocessor providing a digital signal to activate a triac connected to a fuser heating element. The triac selectively gates by cycle stealing the input voltage source across the heating element. A plurality of ranges of digital signals and a plurality of corresponding triac activation rates are shown for responding to the input voltage to regulate the fuser heating element.

Other prior art control systems such as U.S. Pat. No. 3,735,092 teach the use of a thermistor providing a signal in response to changes in fuser temperature. The signal is conveyed to a switching amplifier. When the switching amplifier is triggered to a conducting state, the switch is closed completing the circuit to the fuser heat lamp. The switching of the amplifier to the non-conductive state opens a switch to interrupt power to the fuser lamp and the switching amplifier is biased to provide a specific switching response through suitable resistor combinations.

The prior art includes U.S. Pat. No. 3,532,885 showing the use of a step down transformer connecting a power supply to a heating lamp. The transformer provides an output to a power regulating circuit also receiving a feedback signal representing the voltage across the heating lamp. The power regulating circuit in response to the output of the transformer and the feedback signal triggers a thyristor controlling line voltage across the fuser lamp.

A difficulty with these types of systems is the need to monitor relatively high line voltages or the need to change circuit elements such as capacitors and resistors to be able to vary the parameters of control.

Another difficulty with the above prior art control schemes is that they are not suitable for adaption to different power outlets such as 3.3, 3.0, 2.2 and 1.5 kva. The prior art systems are directed to regulating a voltage outlet rather than adaption of a machine to significantly different power outlets.

Another method of control is a sampling technique in which the voltage across the heating element is sampled by a light bulb. The emitted light from the light bulb is proportional to R.M.S. voltage across the lamp. A photodetector converts the light into a direct current voltage for controlling a switch and a triac. The triac is gated in order to remove cycles of alternating current across the lamp to regulate the R.M.S. voltage across the lamp. A disadvantage with this type of control is that the light bulb degrades with time and is often sensitive to ambient temperature changes.

It would therefore be desirable to provide a machine control system that is easily and economically adaptable to power outlets providing a wide range of available power. It would also be desirable to provide a control that is simple and optimizes the use of available power.

Accordingly, it is an object of the present invention to provide an improved reproduction machine control allowing the reproduction machine to be used in a variety of power environments, in particular maximizing the use of power available. Further advantages of the present invention will become apparent as the following description proceeds, and the features characterizing the invention will be pointed out in the claims annexed to and forming a part of this specification.

Briefly, the present invention is concerned with a machine control having a programmable non-voltaile memory and microprocessor to control power to a fuser lamp in a manner to adapt the machine to distinct power outlets. The non-volatile memory is programmed to indicate the availability of a particular power output. The control monitors the memory and in turn gates a triac controlling the fuser lamp to apply the maximum possible power to the fuser. Typically, at a 3.3 kva outlet, the fuser could be operated at full operation while the other machine components are running to produce copies. On the other hand, if the machine is operating at a 3.0 or a 2.2 kva outlet, full power could not be delivered to the fuser while the machine is operating. The machine would adapt to operate at reduced power to the fuser until the fuser temperature drops below a minimum temperature level.

For a better understanding of the present invention reference may be had to the accompanying drawings wherein the same reference numerals have been applied to like parts and wherein.

Figure 1:
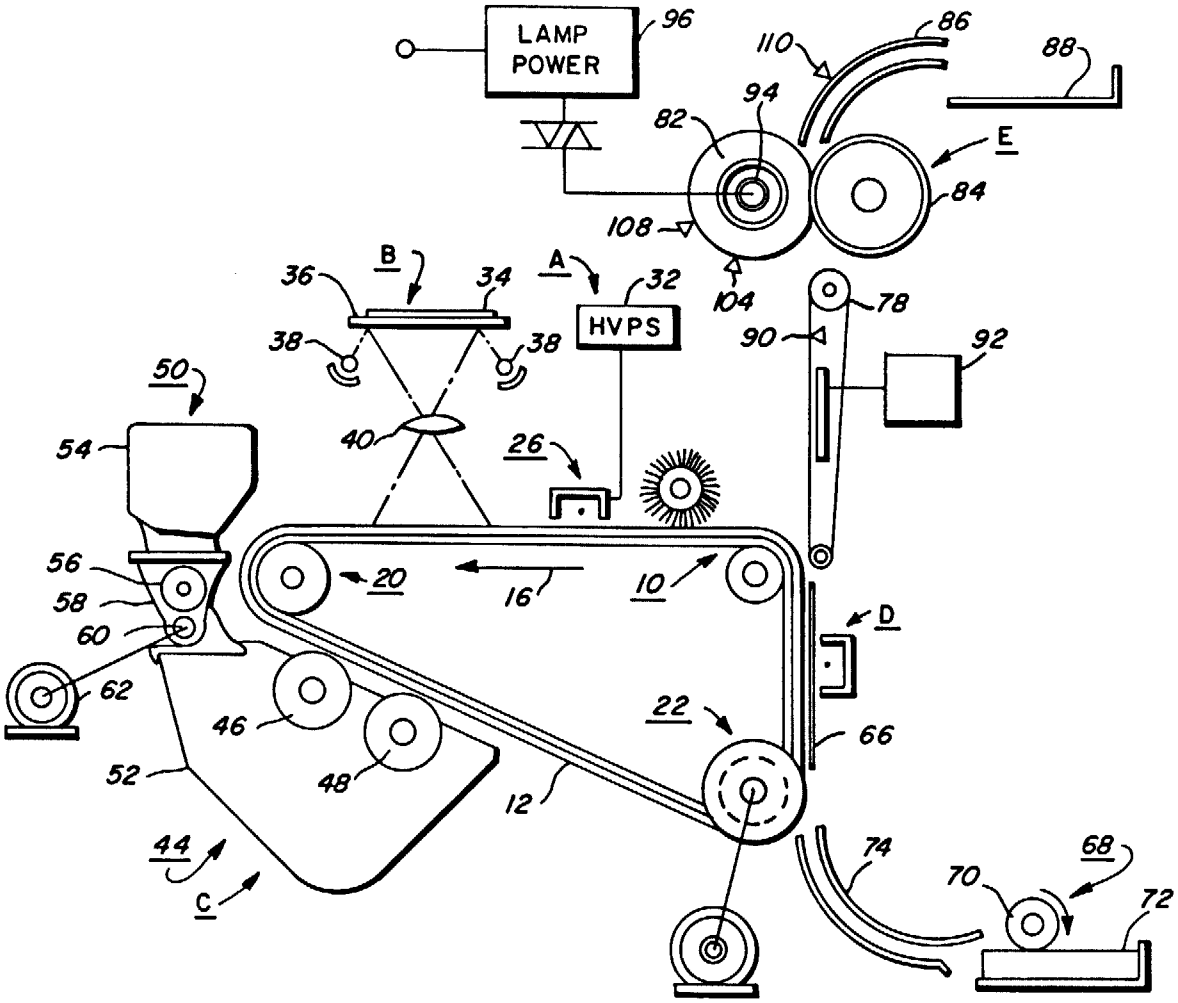
FIG. 1 is an elevational view of a reproduction apparatus incorporating the present invention.

With reference to FIG. 1, there is illustrated an electrophotographic printing machine having a belt 10 with a photoconductive surface 12 moving in the direction of arrow 16 to advance the photoconductive surface 12 sequentially through various processing stations. At charging station A, a corona generating device 26 electrically connected to high voltage power supply 32 charges the photoconductor surface 12 to a relatively high substantially uniform potential. Next, the charged portion of the photoconductive surface 12 is advanced through exposure station B. At exposure station B, an original document 34 is positioned upon a transparent platen 36. Lamps 38 illuminate the original document and the light rays reflected from the original document 34 are transmitted through lens 40 onto photoconductive surface 12.

A magnetic brush development system 44 advances a developer material into contact with the electrostatic latent image at development station C. Preferably, the magnetic brush development system 44 includes two magnetic brush developer rollers 46 and 48. Each developer roller forms a brush comprising carrier granules and toner particles. The latent image and test areas attract toner particles fron the carrier granules forming a toner powder image on the latent image. A toner particle dispenser 50 is arranged to furnish additional toner particles to housing 52. In particular, a foam roller 56 disposed in a sump 58 dispenses toner particles into an auger 60 comprising a helical spring mounted in a tube having a plurality of apertures. Motor 62 rotates the helical member of the auger to advance the toner particles to the housing 52.

At the transfer station D, a sheet of support material 66 is moved into contact with the toner powder image. The sheet of support material is advanced to the transfer station by sheet feeding apparatus 68, preferably including a feed roll 70 contacting the uppermost sheet of stack 72. Feed roll 70 rotates so as to advance the uppermost sheet from stack 72 into chute 74. The chute 74 directs the advancing sheet of support material into contact with the photoconductive surface 12 in timed sequence in order that the toner powder image developed thereon contacts the advancing sheet of support material at the transfer station. Transfer station D includes a corona generating device 76 for spraying ions onto the underside of sheet 66. This attracts the toner powder image from photoconductive surface 12 to sheet 66.

After transfer, the sheet continues to move onto prefuser vertical transport or conveyor 78 advancing the sheet to fusing station E. Fusing station E generally includes a heated fuser roller 82 and a backup roller 84 for permanently affixing the transferred powder image to sheet 66. The sheet 66 passes between nip formed by the fuser rollers 82, 89 with the toner powder image contacting fuser roller 82. After fusing, the chute 86 drives the advancing sheet 66 to catch tray 88 for removal by the operator.

With particular reference to the prefuser conveyor 78, a coin type prefuser jam switch 90 is located in the conveyor. Jam detection is obtained by the interrogation of the switch at the correct times for both the presence and the absence of paper. There is also an AC fan 92 at the conveyor 78 providing vacuum to hold a copy on the transport. Normally, the fan is turned on in the print cycle. However, since copies may have to remain in position on the transport during jam clearance, independent control is required.

Figure 2:
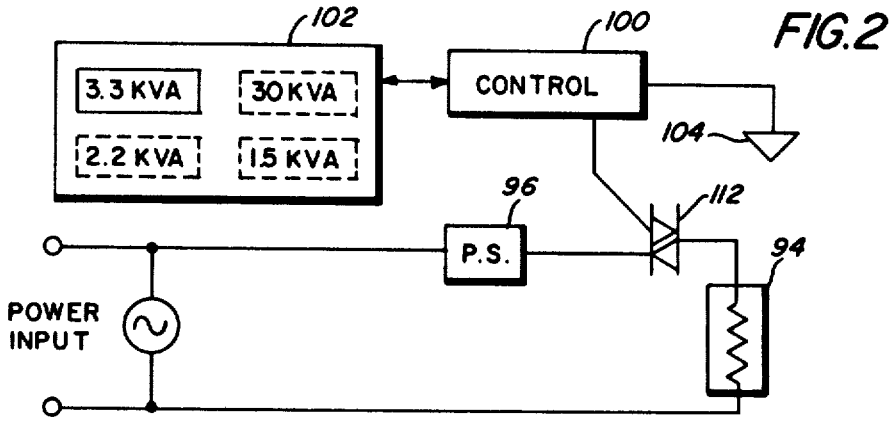
FIG. 2 is a schematic showing the control of the fuser lamp in accordance with the present invention.

In accordance with the present invention, at the fuser station itself, the fuser includes a lamp heater 94 within the fuser roll 82. The fuser lamp 94 within the fuser roll provides the heat to warm the roll and fuse the toner to the paper. The power supply 96 to the lamp is varied in accordance with the power available to the machine. With reference to FIG. 2, a microprocessor controller 100 electrically connected to non-volatile memory 102 determines when power to the lamp is required via feedback from thermistor 104. The controller 100 activates a triac 112 to turn on the lamp 94. In order to conform to certain power locations, the lamp 94 cannot be completely activated in the print mode. Consequently, a cycle stealing procedure is used by the control 100 to regulate maximum power delivered to the lamp 94.

The thermistor 104 is preferably a soft touch thermistor and is mounted at one end of the fuser roll 82 to monitor roll temperature. The output of the thermistor 104 and related interface circuitry is a 0–10 volt signal proportional to the roll temperature. The thermistor 104 output signal is read by the control 100 through a not shown analog to digital channel and compared to a temperature set point stored in the control 100 memory. If the value is below the set point, the control signal to the lamp is turned on, causing the temperature of roll 82 to increase. An overtemperature thermal fuse 108 is employed as a safety feature to break power to the fuser and machine, if for any reason the temperature exceeds a maximum safe limit.

There is also a sealed contact switch 110 called the fuser jam switch located at the exit of the fuser. The switch is interrogated by the control 100 at the time the paper is exiting the fuser nip. The primary purpose is to prevent a fuser wrap condition whereby a copy sticks to the fuser roll 82. The switch is also sampled to see that paper has successfully cleared the area.

In accordance with the present invention, as illustrated in FIG. 2, a code word is stored in memory according to the available power input. For example, for a 3.3 kva power outlet, a 3.3 kva code word will be stored in the non-volatile memory 102. This code word can be stored in the memory at the time of manufacture or by a service representative in the field. If the machine is to be used at the power outlet providing power less than 3.3 kva, such as 3.0 kva, 2.2 kva or 1.5 kva, the service representative can alter the non-volatile memory 102 to contain the code word corresponding to the power available. Thus, a given machine can be adapted for distinct power outlets by merely changing the code word stored in the non-volatile memory.

In operation, the machine control 100 detects the code word in the non-volatile memory 102 and in response to the code word detected, selectively activates a triac 112 to control the power delivered to the lamp 94. The triac 112 under the direction of control 100 determines the power from the power supply 96 delivered to the lamp 94.

Suppose, for example, the machine is plugged into a 3.3 kva electrical outlet. Assume also that the maximum power that can be delivered to the fuser lamp 94 is 1200 watts and that all other components of the reproduction machine require 2100 watts of power. In this power environment, the reproduction machine and fuser operate a full power. However, now assume that there is only a 3.0 kva power outlet available and that the 3.0 kva code word has been stored in the non-volatile memory 102.

Figure 3:
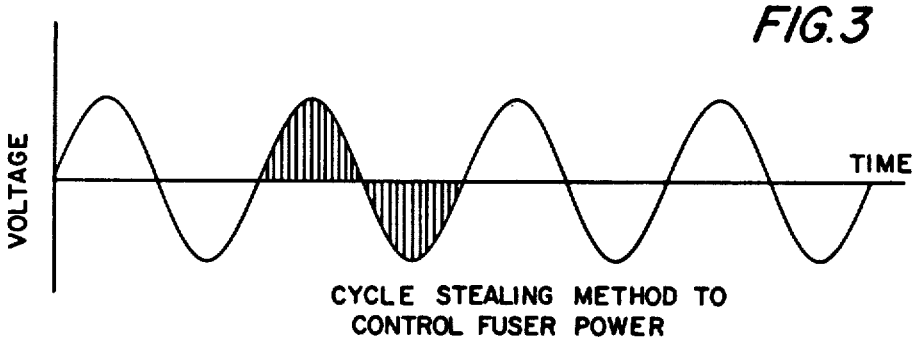
FIG. 3 is an illustration of the cycle stealing principal to control the fuser.

In this situation, since the machine still requires 2100 watts of power for operation, there are only 900 watts of power available for the fuser lamp 94. Thus, the control 100 will selectively activate the triac 112 in order that the power supply 96 applies 900 watts rather than 1200 watts to the lamp 94. Providing only 900 watts rather than 1200 requires that the triac 112 not be activated for specific cycles of the power delivered to the lamp 94. For example, with reference to FIG. 3, illustrating the voltage delivered to the lamp 94, one cycle of voltage is stolen or not delivered for each 4 cycles. The stolen cycle is illustrated by the shaded area. In a similar manner, more cycles of power can be stolen in order to deliver even less power to the lamp 94.

It should be noted that, for example, at a 2.2 kva oulet only 100 watts are available for the fuser lamp. Eventually, the heat of the fuser lamp will be insufficient to properly fuse the copies. Therefore, upon the fuser reaching a predetermined minimum temperature level, the other machine components are reverted to a standby condition. Maximum power is then delivered to the fuser to raise the temperature to a suitable level to resume normal copy production operation.

Figure 4:
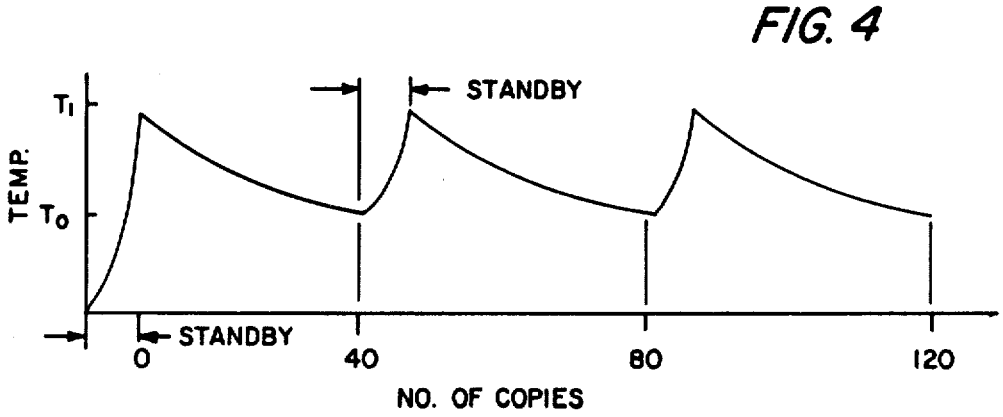
FIG. 4 is an illustration of the copies produced/fuser temperature relationship to operate the fuser at reduced power in accordance with the present invention.

This is illustrated in FIG. 4 with the maximum temperature level being T1 and the minimum temperature level being T0 shown parallel to the x axis of the graph. There is initially a stand-by condition needed to elevate the temperature to the T1 level. At this point, the machine begins the copy producing operation and 100 watts of energy are available to fuse copies. The fuser, however, must gradually use more and more of the stored heat energy in the fuser roll. This is illustrated by the descending curve. Eventually, the temperature of the fuser gradually decreases until it reaches the temperature level T0. At this point, a certain number of copies, for example 40 copies, have been produced during the time it takes the temperature of the fuser to drop from T1 to T0.

The machine then reverts to the standby condition and all the available power is used by the fuser to elevate the temperature to T1. At this point, there will be the production of the next 40 copies until the temperature again decreases to the T0 level. It should be noted that there are various combinations of temperature levels and number of copies produced between standby states for any one given power outlet. Of course, if substantial power is continuously available to the fuser, such as at a 3.0 kva outlet, considerably more copies can be produced before the temperature drops to a minimum level.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. In a reproduction machine for producing impressions of an original, the reproduction machine having a photosensitive member, a plurality of discrete operating components cooperable with one another and the photosensitive member to electrostatically produce the impression upon support material, one of the discrete operating components being a fuser having a fuser lamp, and a controller including a memory, the method of operating the machine at a variety of distinct power outlets comprising the steps of:

setting the memory to manifest a given power availability, scanning the memory to determine the power available for the machine, responsive to the manifestation of the power available, selectively gating the fuser lamp to apply power to the fuser in accordance with the available power;

monitoring the temperature of the fuser;

holding the machine components other than the fuser at standby upon detecting the fuser temperature below a first predetermined level; and operating the machine components at normal operation upon detecting that the fuser temperature at a second predetermined level.

2. A method of claim 1 including the steps of providing a first level power to operate the components of the reproduction machine other than the fuser to produce copies and providing a second level of power to the fuser to operate the fuser during operation of the other machine components, and inhibiting the machine from producing copies when the heat power delivered by the fuser to copies is insufficient to produce acceptable fused copies.

3. The method of operating the machine of claim 1 including the step of operating the fuser from stored heat energy while the machine is producing copies.

4. The method of operating a reproduction machine having a fuser for fixing images produced on copies and having other operating components including the steps of determining the power available to the reproduction machine, providing a first power level to operate said other operating components, providing a residue power level, the residue power level being the difference in power between the available power and the power to operate the other operating components, to operate the fuser;

operating the other operating components and the fuser until the fuser temperature drops below a first temperature level, inhibiting operations of the other operating components upon detecting the fuser below said first temperature level, providing the first power level and residue power level to the fuser to raise the fuser temperature to a second level above said first level, resuming operation of the other operating components to produce copies upon the fuser temperature reaching the second level.

5. The method of claim 4 wherein the step of operating the fuser at the residue power level includes the step of operating the fuser with stored heat energy until the fuser drops below a predetermined level.

6. The method of operating a reproduction machine having a control with memory, a fuser for fixing images produced on copies, and other operating components including the steps of setting a power available indication in the memory for a particular power environment, detecting the power available indication during machine power up, providing a first power level to operate said other operating components, providing a residue power level to operate the fuser, the residue power level being the difference in power between the indicated available power and the power required to operate the other operating components.

7. The method of claim 6 wherein the step of determining the power available to the reproduction machine includes the step of monitoring the control memory for the indication of the power available.

8. The method of claim 7 wherein the memory is a non-volatile memory and the step of setting the power availability indication includes the step of programming the non-volatile memory with a code word corresponding to a particular power availability.

9. The method of claim 6 including the steps of, determining that the fuser temperature has dropped below a minimum level, inhibiting the other operating components from producing copies in response to the temperature dropping below the minimum level, and providing both the first power level and the residue power level to the fuser to raise the fuser temperature to an operating level.

10. The method of claim 9 including the step of resuming operation of the other operating components to produce copies when the fuser temperature reaches the operating level.

11. The method of claim 10 including the step of providing only residue power to the fuser when the other operating components are producing copies.

* * * * *